US007855333B2

(12) United States Patent
Miyajima et al.

(10) Patent No.: US 7,855,333 B2
(45) Date of Patent: Dec. 21, 2010

(54) MUSIC EDIT DEVICE AND MUSIC EDIT METHOD

(75) Inventors: Yasushi Miyajima, Kanagawa (JP); Kosei Yamashita, Kanagawa (JP); Motoyuki Takai, Tokyo (JP); Akihiro Komori, Tokyo (JP); Norikazu Hiraki, Kanagawa (JP); Yuichi Abe, Tokyo (JP)

(73) Assignee: Sony Corporation, Tokyo (JP)

( * ) Notice: Subject to any disclaimer, the term of this patent is extended or adjusted under 35 U.S.C. 154(b) by 273 days.

(21) Appl. No.: 12/092,641

(22) PCT Filed: Dec. 7, 2006

(86) PCT No.: PCT/JP2006/324890

§ 371 (c)(1),
(2), (4) Date: May 5, 2008

(87) PCT Pub. No.: WO2007/066819

PCT Pub. Date: Jun. 14, 2007

(65) Prior Publication Data

US 2009/0133568 A1 May 28, 2009

(30) Foreign Application Priority Data

Dec. 9, 2005 (JP) ..... 2005-356825

(51) Int. Cl.
*G10H 7/00* (2006.01)

(52) U.S. Cl. ..... 84/612; 84/625; 84/660

(58) Field of Classification Search ..... 84/600–602, 84/612, 625, 636, 652, 660, 668
See application file for complete search history.

(56) References Cited

U.S. PATENT DOCUMENTS 7,189,913 B2 * 3/2007 Moulios et al. ..... 84/612

(Continued)

FOREIGN PATENT DOCUMENTS

JP 6 342282 12/1994

(Continued)

OTHER PUBLICATIONS

U.S. Appl. No. 12/093,059, filed May 8, 2008, Komori, et al.
U.S. Appl. No. 12/095,745, filed Jun. 2, 2008, Yamashita, et al.

*Primary Examiner*—David S. Warren
(74) *Attorney, Agent, or Firm*—Oblon, Spivak, McClelland, Maier & Neustadt, L.L.P.

(57) ABSTRACT

A remix processing section performs a remix process based on both meta data that are pre-generated corresponding to song data and that contain at least a time-based beat position and a file for deciding a remix pattern. A synchronous reproduction controlling section generates a master beat, sends the master beat to the remix processing section, and reproduces a plurality of songs based on individual entries of the meta data according to the remix process which the remix processing section has designated corresponding to the remix pattern and the meta data. A mixing section mixes songs reproduced by the synchronous reproduction controlling section. A music editing apparatus that can accomplish editing of overlaying or connecting whole or part of each of many songs recorded in a record medium such as a hard disk or a flash memory with their beats matched is provided.

12 Claims, 24 Drawing Sheets

U.S. PATENT DOCUMENTS

| | | | | |
|---|---|---|---|---|
| 7,208,672 | B2 * | 4/2007 | Camiel | 84/625 |
| 7,592,534 | B2 * | 9/2009 | Yoshikawa et al. | 84/612 |
| 2003/0065517 | A1 * | 4/2003 | Miyashita et al. | 704/278 |
| 2003/0205124 | A1 * | 11/2003 | Foote et al. | 84/608 |
| 2004/0159221 | A1 * | 8/2004 | Camiel | 84/660 |
| 2004/0254660 | A1 * | 12/2004 | Seefeldt | 700/94 |
| 2005/0211072 | A1 * | 9/2005 | Lu et al. | 84/612 |
| 2006/0048634 | A1 * | 3/2006 | Lu et al. | 84/612 |
| 2006/0107822 | A1 * | 5/2006 | Bowen | 84/612 |
| 2007/0074618 | A1 * | 4/2007 | Vergo | 84/612 |
| 2008/0097633 | A1 * | 4/2008 | Jochelson et al. | 700/94 |
| 2009/0139389 | A1 * | 6/2009 | Bowen | 84/636 |
| 2009/0178542 | A1 * | 7/2009 | Jochelson et al. | 84/609 |

FOREIGN PATENT DOCUMENTS

| | | |
|---|---|---|
| JP | 7 295589 | 11/1995 |
| JP | 2000 56780 | 2/2000 |
| JP | 2001 109470 | 4/2001 |
| JP | 2001 265333 | 9/2001 |
| JP | 2002 6842 | 1/2002 |
| JP | 2003 44046 | 2/2003 |
| JP | 2003 50588 | 2/2003 |
| JP | 2003 108132 | 4/2003 |
| JP | 2003 114677 | 4/2003 |
| JP | 2003 114678 | 4/2003 |
| JP | 2003 345351 | 12/2003 |
| JP | 2004 198759 | 7/2004 |
| JP | 2005 521979 | 7/2005 |

* cited by examiner

Fig. 5

30

31 32 33

| BAR/BEAT | ATTRIBUTE | SAMPLE POSITION |
|---|---|---|
| 11 | 01800001 | 23190 |
| 12 | 01000001 | 65280 |
| 13 | 01000001 | 83200 |
| 14 | 01000001 | 100416 |
| 21 | 01800001 | 118400 |
| 22 | 01000001 | 136192 |

Fig. 9

60

| 61 SONG ID (FILE) | 62 REPRODUCTION PORTION | 63 EFFECT UPON REPRODUCTION | 64 CONNECTION PATTERN | 65 EFFECT UPON CONNECTION | 66 CONNECTION SE |
|---|---|---|---|---|---|
| ID_A | CATCHY PART | NONE | CROSS-FADE | REVERB | NONE |
| ID_B | INTRODUCTION | LOW-CUT | CUT-IN | LOW-CUT | NONE |
| ID_C | BAR 8-20 | NONE | CROSS-FADE | DISTORTION | SE_A |
| ID_D | WHOLE | HIGH-CUT | SIMULTANEOUS REPRODUCTION: CATCHY PART | NONE | NONE |
| ID_E | CATCHY PART | LOW-CUT | NONE | NONE | NONE |

MUSIC EDIT DEVICE AND MUSIC EDIT METHOD

TECHNICAL FIELD

The present invention relates to a music editing apparatus and method of editing as materials music content or the like obtained, for example, from song parts, bars, and so forth into which songs are divided and creates new songs (music content).

BACKGROUND ART

As memory type audios have become common, users daily carry a large number of songs with them. With memory type audios that allow their users to listen to a large number of songs continuously without need to change mediums, a style in which the users not only successively listen to songs of each CD album, but listen to songs shuffled in all CD albums and their favorite songs arranged as play lists has become common. It can be said that the degree of freedom of which the users listen to their favorite songs in their favorite orders not in the orders of songs recorded in albums has increased.

However, it is assumed that the users listen to each song from the beginning to the end. In addition, there is a non-sound region between songs. In other words, one song is the minimum unit. Thus the user has to listen to music on the basis of one song. The user's concentration, namely his or her enthusiasm, breaks at such a non-sound region between songs. As a result, the users are difficult to continuously listen to songs with his or her tension kept.

FIG. 23 shows conventional music reproduction using song A and song B. In this case, the two songs are reproduced with their original tempos. Of course, there is a non-sound region between these songs.

Thus a technique of combining a plurality of music materials and editing them was developed. Japanese Patent Application Laid-Open No. 2003-44046 discloses a technique of combining a plurality of music materials that are input through a user's keyboard and mouse and allowing him or her to interactively edit them and to enjoy the reproduced songs. In the technology, sound pieces such as sound patterns and one-shots and tips composed of effects applicable to sound pieces are assigned to individual keys of the keyboard. When the user presses the keys, tips corresponding thereto are combined and output. When a plurality of keys are pressed at the same time, corresponding tips are combined and output. In addition, when keys are successively pressed, corresponding tips are chronologically combined and thereby a song is composed.

However, with the foregoing technique disclosed as Japanese Patent Application Laid-Open No. 2003-44046, it was difficult to recompose a song by connecting parts of a plurality of songs in such a manner that their beats are matched like with a remix created, for example, by a disc jockey (DJ). A DJ is currently a common occupation. There are label companies that dedicatedly deal with remix music. The number of users who enjoy remix music is increasing.

The present invention was created from the foregoing point of view. An object of the present invention is to provide a music editing apparatus and a music editing method of editing of overlaying or connecting whole or part of each of many songs recorded in a record medium such as a hard disk or a flash memory with their beats matched. Another object of the present invention is to provide a music editing apparatus and a music editing method of connecting whole or part of each song situation by situation in real time and reproducing the connected song.

DISCLOSURE OF THE INVENTION

To solve the foregoing problem, a music editing apparatus of the present invention includes a remix processing section which performs a remix process based on both meta data which are pre-generated corresponding to song data and which contain at least a time-based beat position and a file for deciding a remix pattern; a synchronous reproduction controlling section which generates a master beat, sends the master beat to the remix processing section, and reproduces a plurality of songs based on individual entries of the meta data according to the remix process which the remix processing section has designated corresponding to the remix pattern and the meta data; and a mixing section which mixes songs reproduced by the synchronous reproduction controlling section.

A music editing method of the present invention includes a remix processing step of performing a remix process based on both meta data which are pre-generated corresponding to song data and which contain at least a time-based beat position and a file for deciding a remix pattern; a synchronous reproduction controlling step for generating a master beat, sending the master beat to the remix processing step, and reproducing a plurality of songs based on individual entries of the meta data according to the remix process which the remix processing step has designated corresponding to the remix pattern and the meta data; and a mixing step for mixing songs reproduced by the synchronous reproduction controlling step.

BRIEF DESCRIPTION OF DRAWINGS

FIG. 5 is a schematic diagram showing time-based meta data;

FIG. 9 is a schematic diagram showing a specific example of a remix pattern file;

FIG. 12 is a schematic diagram for describing a connection with cut-in;

BEST MODES FOR CARRYING OUT THE INVENTION

Figure 1:
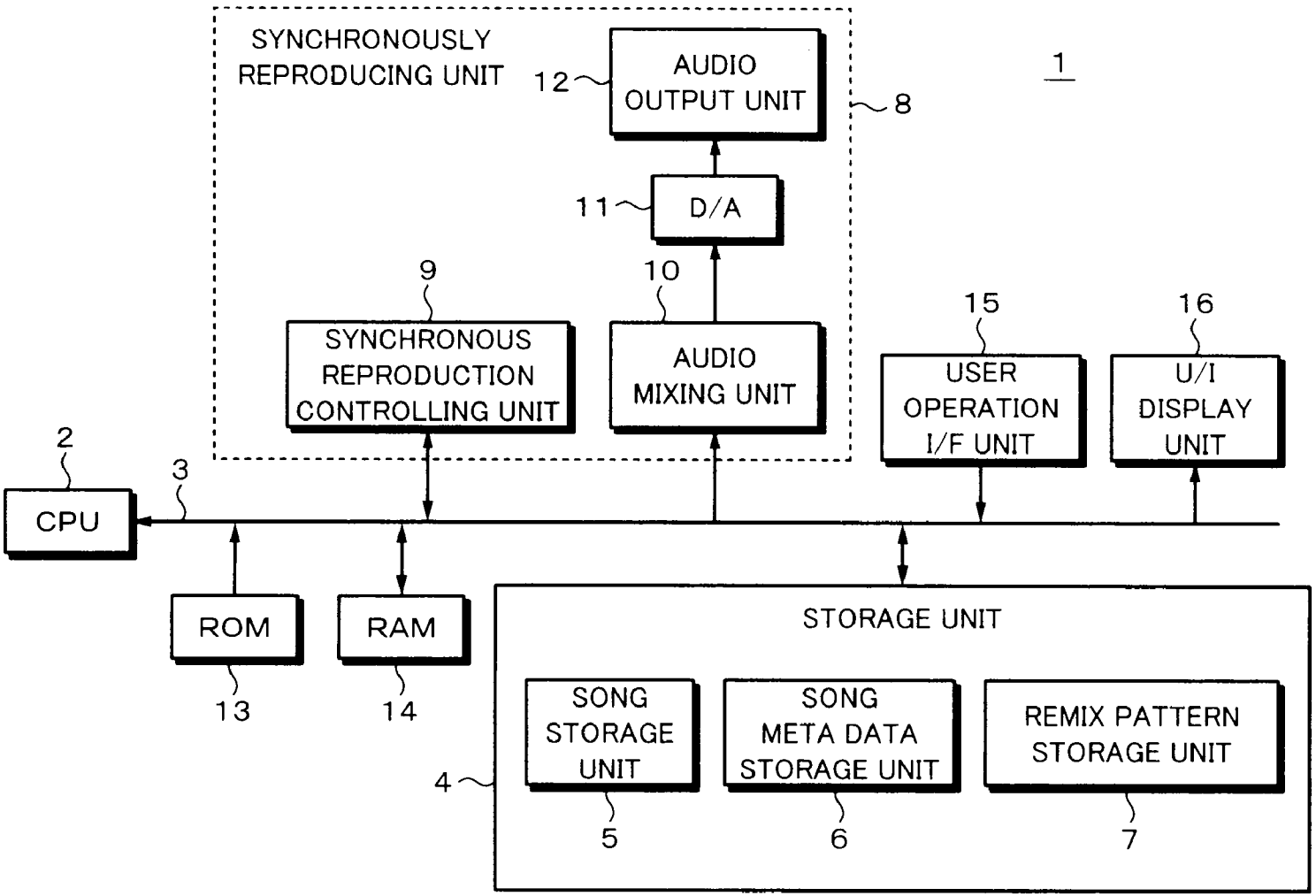
FIG. 1 is a block diagram showing a music editing apparatus 1 according to an embodiment of an apparatus and a method of the present invention.

Next, with reference to the accompanying drawings, best mode embodiments for carrying out the present invention will be described. FIG. 1 is a block diagram showing a music editing apparatus 1 according to an embodiment of an apparatus and method of the present invention.

The music editing apparatus 1 can connect or overlay song A and song B having different tempos as music content data (original data) of songs provided through various types of record mediums such as a hard disk (HD), a compact disc (CD), a mini disc (MD), a digital versatile disc (DVD), and so forth and through networks such as the Internet with meta data described later and reproduce the connected or overlaid song in such a manner that their beats are matched. In other words, the music editing apparatus 1 is an apparatus that automatically performs DJ reproduction.

As shown in FIG. 1, in the music editing apparatus 1, a central processing unit (CPU) 2 is connected to a storage unit 4 and a synchronously reproducing unit 8 through a bus 3. In addition, connected to the CPU 2 through the bus 3 are a ROM 13, a RAM 14, a user operation I/F unit 15, and a user interface (U/I) display unit 16.

The CPU 2 decides a connecting method for songs in real time and supplies necessary song materials to the synchronously reproducing unit 8 at a necessary timing. In addition, corresponding to a user's operation, the CPU 2 designates a tempo and beat synchronization/asynchronization for the synchronously reproducing unit 8.

The storage unit 4 is composed of a song storage unit 5, a meta data storage unit 6, and a remix pattern storage unit 7. The song storage unit 5 is a storage unit that stores data of a plurality of songs. The song storage unit 5 is a storage unit such as a flash memory or a hard disk that a console type music reproducing apparatus or a portable music reproducing apparatus has. Song data that are stored in the song storage unit 5 may be regardless of compressed music data or non-compressed data.

The meta data storage unit 6 is a storage unit such as a flash memory or a hard disc and stores time-based meta data added to songs. As will be described later, meta data are time-based auxiliary data added to songs and describe position information of beats as well as tempos, position information of the beginnings of bars (simply referred to as beginnings), and melody information such as introductions and themes (catchy parts).

Like the song storage unit 5, the remix pattern storage unit 7 is not limited to a particular type as long as it is a storage unit. The remix pattern storage unit 7 is a storage unit that stores a remix pattern file that designates a remix pattern designating method. As will be described later, a remix pattern file is not only a file that describes the order of songs, but a file that describes a song order plus a manner of combining song A and song B or a manner of what parts of song A and song B are used and where they are combined.

The synchronously reproducing unit 8 is a signal processing block with which the music editing apparatus 1 automatically performs the DJ reproduction. The synchronously reproducing unit 8 reproduces song materials designated by a remix control function of the CPU 2 in synchronization with a reference beat. The synchronously reproducing unit 8 is composed of a synchronous reproduction controlling unit 9, an audio mixing unit 10, a digital/analog converting unit (D/A) 11, and an audio output unit 12.

The synchronous reproduction controlling unit 9 has a plurality of audio signal generating sections and reproduces a plurality of audio signals in synchronization with a locally generated clock signal. In addition, the synchronous reproduction controlling unit 9 always monitors the position of a song that is being currently reproduced on the basis of meta data supplied from the meta data storage unit 6 and sends the current reproduction position (such as a reproduction position as a sample count in the song) and a reproduction position as a bar count and a beat count back to the remix process function section of the CPU 2.

The audio mixing unit 10 mixes a plurality of audio signals generated by the plurality of audio signal generating sections of the synchronous reproduction controlling unit 9 and outputs the mixed signal. The D/A 11 converts the digital signal reproduced by the audio mixing unit 10 into an analog signal. The audio output unit 12 amplifies the analog audio signal supplied from the D/A 11 and outputs the amplified signal to a speaker, a headphone, or the like.

The ROM 13 stores a music editing program composed of processes based on the music editing method according to the present invention. In addition, the ROM 13 stores various types of default data. The RAM 14 becomes a work area with which the CPU 2 executes the music editing program. In addition, the RAM 14 stores various types of update data with which the CPU 2 executes the music editing program.

The user operation I/F unit 15 is, for example, a keyboard, a mouse, a touch panel, and/or the like that accepts user's operations. The U/I display unit 16 is a display section including a touch panel that displays a current operation state and a music editing process state and accepts user's operations. The U/I display unit 16 is, for example, a liquid crystal display unit. Of coarse, the U/I display unit 16 may be a CRT.

Figure 2:
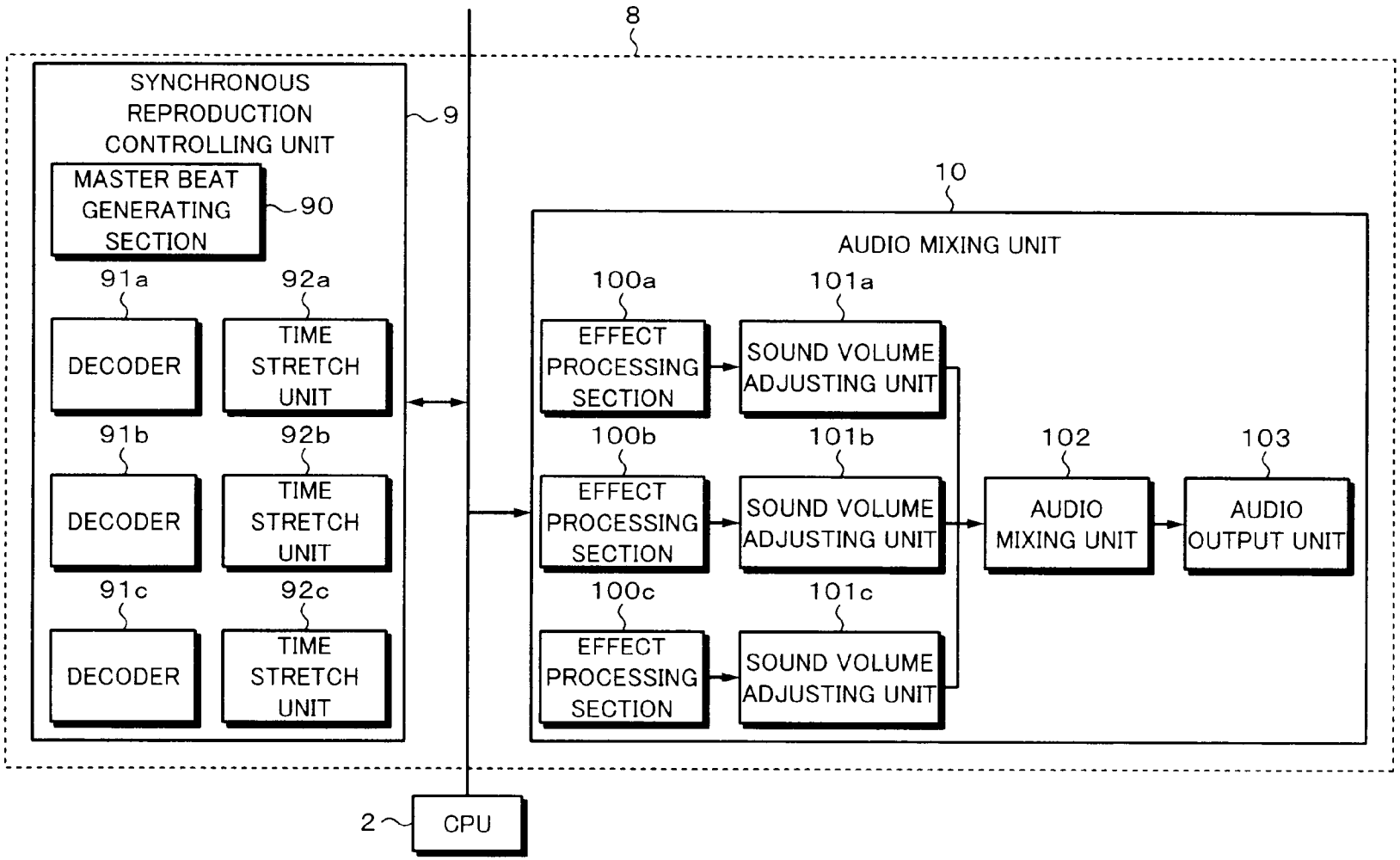
FIG. 2 is a block diagram showing detailed structures of a synchronous reproduction controlling unit and an audio mixing unit.

FIG. 2 is a block diagram showing detailed structures of the synchronous reproduction controlling unit 9 and the audio mixing unit 10. The synchronous reproduction controlling unit 9 is composed of a master beat generating section 90 and three audio signal generating sections. The master beat generating section 90 generates a clock equivalent to a beat. Specifically, the master beat generating section 90 outputs a tempo of a remix and a beat signal in synchronization with the tempo. The master beat generating section 90 generates a bar beginning signal and a regular beat signal other than the bar beginning signal corresponding to a designated rhythm (in four-four rhythm, three-four rhythm, and so forth) and outputs them.

The three (tracks of) audio signal generating sections have three tracks to output a plurality of stereo sounds in real time, as a typical example, song A, song B, and sound effect (SE). Of course, the audio signal generating section may have four tracks, five tracks, or more corresponding to the number of songs. The audio signal generating section synchronously reproduces bar/beat positions of songs corresponding to the bar/beat positions of the master beat based on the synchronous signal (clock or beat) generated by the master beat generating section 90.

For individual tracks, decoders 91*a*, 91*b*, and 91*c* and time stretch units 92*a*, 92*b*, and 92*c* are provided. The decoders 91*a*, 91*b*, and 91*c* decode compressed sounds that have been compressed according to MP3 or ATRAC and output decoded sounds as PCM data. In this case, since SE is short and its data size is small, it does not always need to have been compressed. Thus the decoder for the SE track may be omitted. The time stretch units 92*a*, 92*b*, and 92*c* are units that convert a reproduction speed while the intervals of songs are kept constant. The time stretch units 92*a*, 92*b*, and 92*c* cause tempos of song materials to match the tempo of the reference beat based on meta data supplied from the meta data storage unit 6. The time stretch units 92*a*, 92*b*, and 92*c* perform a process of changing the reproduction speed in real time based on the ratio of the original tempos of songs and the tempo of the master beat. Thus the original tempos of songs can be matched with the tempo of the master beat. Of course, as described above, the intervals of songs are not changed.

The audio signal generating sections may have a pitch shifter function. The pitch shifter function changes the interval of a song while the reproduction speed is kept constant. The pitch shifter function is used to musically harmonize song materials having different intervals and pitches. However, the pitch shifter function is not an essential function, but an additional function.

The audio mixing unit 10 has three effect processing sections 10*a*, 10*b*, and 100*c* and three sound volume adjusting units 101*a*, 101*b*, and 101*c* corresponding to the three tracks of audio signal generating sections. The outputs of these three systems are mixed by an audio mixing unit 102, amplified by an audio output section 103, and then output to the external speaker, headphone, or the like. The audio mixing unit 10 can perform an effect process and an sound volume adjustment process for the individual tracks of the output audio signals supplied from the audio signal generating sections. The synchronous reproduction controlling unit 9 and the audio mixing unit 10 are connected to the CPU 2 through a CPU bus or a local bus of the synchronous reproducing unit.

Figure 3:
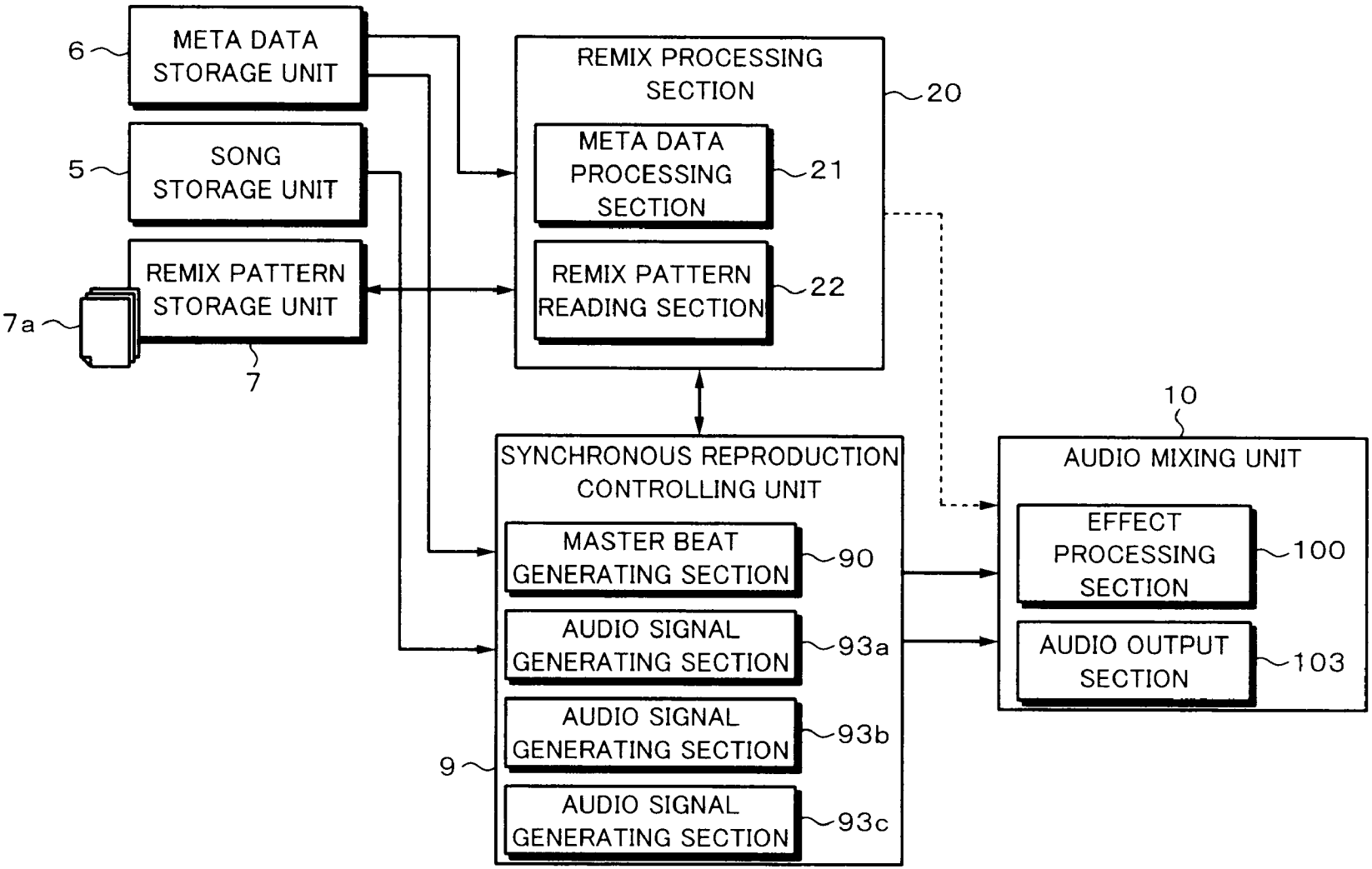
FIG. 3 is a functional block diagram showing the music editing apparatus.

FIG. 3 is a functional block diagram of the music editing apparatus 1. In FIG. 3, a function of the CPU 2 shown in FIG. 1 as a hardware structure is represented by a remix processing section 20. The remix processing section 20 is composed of a meta data processing section 21 and a remix pattern reading section 22.

In the remix processing section 20, the meta data processing section 21 processes meta data stored in the meta data storage unit 6. As described above, time-based meta data have been added to songs. Meta data contain not only information about a tempo, but position information of beats, bar beginning position information, and melody information of an introduction, a catchy part, and so forth.

The meta data processing section 21 reads time-based meta data corresponding to the current song and checks the position information of the song according to designated remix pattern information that has been read by the remix pattern reading section 22. For example, knowing the current beat position and the positions of beats of songs to be combined, the meta data processing section 21 decides in what manner to reproduce songs and a sound effect at what timings.

Moreover, in the remix processing section 20, the remix pattern reading section 22 reads a remix pattern file 7*a* stored in the remix pattern storage unit 7. The remix pattern file 7*a* is a file that designates whether or not to perform fade-out, whether or not to perform cut-out, and what SE to use. A remix pattern may be a data sequence designated by the user or a third party (commanding in what manner to connect this song) or created according to an automatically creating algorithm (namely, a remix decided on the machine side).

In the synchronous reproduction controlling unit 9, the master beat generating section 90 generates a master beat, and sends the master beat to the remix processing section 20, and reproduces a plurality of songs based on individual entries of meta data supplied from the meta data storage unit 6 according to the remix process designated by the remix processing section 20 on the basis of a remix pattern and meta data.

Figure 4:
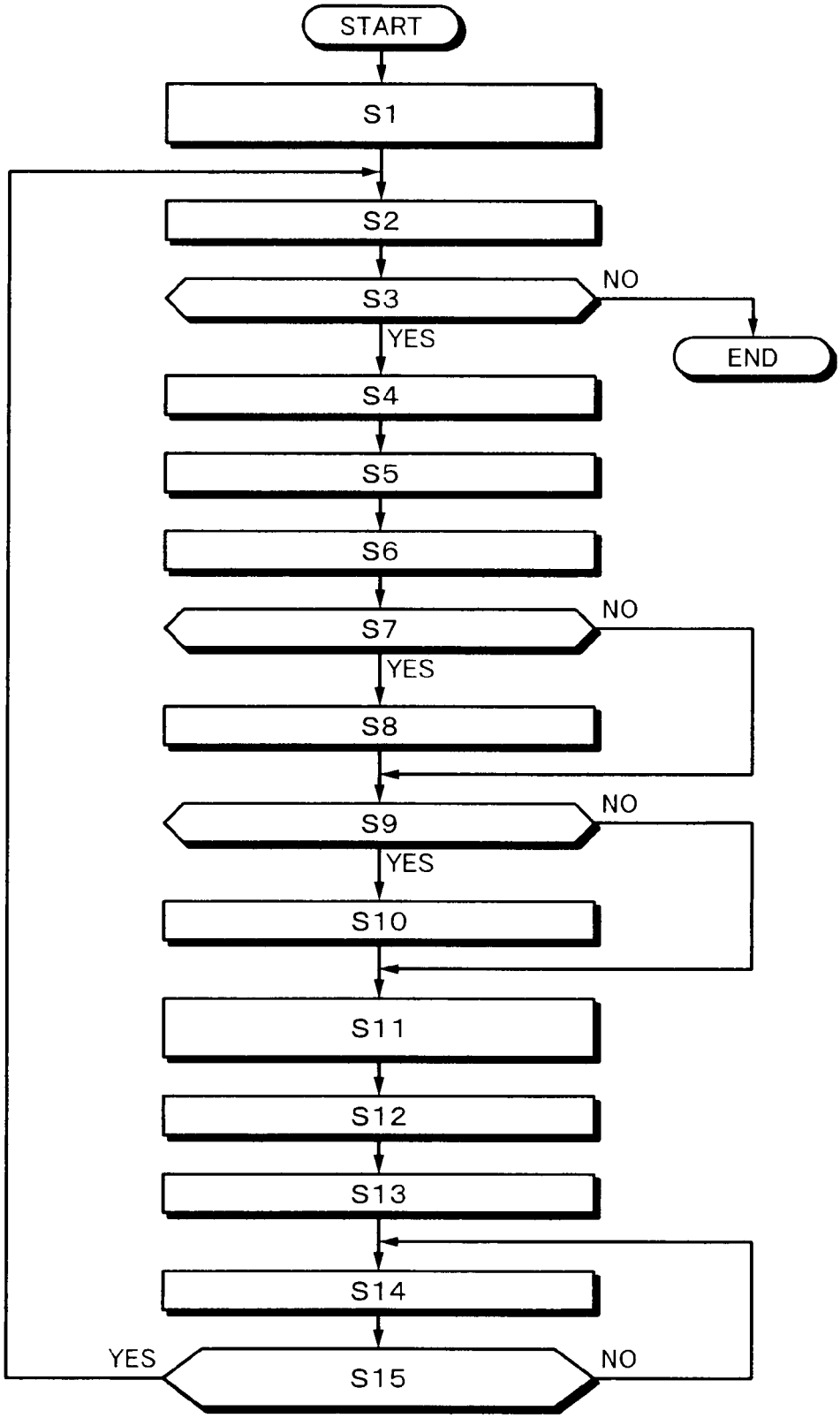
FIG. 4 is a flow chart showing processes of a music editing program that the music editing apparatus executes through a CPU.

FIG. 4 shows processes of a music editing program that the music editing apparatus 1 executes through the CPU 2. This music editing program is an embodiment of the music editing method according to the present invention.

First, in the remix processing section 20 of the CPU 2, the remix pattern reading section 22 reads the remix pattern file 7*a* from the remix pattern storage unit 7 and obtains the remix pattern file 7*a* (at step S1). Thereafter, the synchronous reproduction controlling unit 9 is caused to obtain a song, for example, a first song (at step S2). When there is another song (YES at step S3), a tempo of the master beat generating section 90 of the synchronous reproduction controlling unit 9 is decided (at step S4). The tempo may be fixed at 140 or the user may designate the tempo. Thereafter, a connection pattern (described in the pattern file) is obtained (at step S5).

Since the pattern that connects songs has been decided, meta data of the songs are obtained (at step S6). For example, meta data of song B are obtained. Thereafter, it is determined whether or not the effect process is necessary on the basis of the remix pattern file (at step S7). When necessary (YES), the effect processing section 100 is activated to perform a predetermined effect (at step S8).

Thereafter, it is determined whether or not the sound volume fading process is necessary on the basis of the remix pattern file (at step S9). For example, it is selected whether or not sound volume fade of increasing or decreasing sound volumes of song A and song B that are edited and overlaid is necessary. When necessary (YES), a fade parameter is set (at step S10). Although it has been assumed that sound volumes are automatically increased or decreased, their fade parameters are set.

Thereafter, the original tempos of the songs are set to the master beat generating section 90 of the synchronous reproduction controlling unit 9 (at step S11). The original tempos of the songs have been added to meta data of the songs. Thereafter, a free audio signal generating section of the synchronous reproduction controlling unit 9 is obtained. In the foregoing specific example, although an example of three channels was described, a free audio signal generating section is obtained and a song to be reproduced is set to the obtained audio signal generating section (at step S13).

After having obtained the current reproduction position of each song (at step S14), it is determined whether or not a point at which the next song is prepared has occurred (at step S15). When SE is, for example, cross-fade, it ends several bars before the relevant bar. When SE is, for example, cut-in, since it immediately starts, it can be prepared one bar before it. Of course, simultaneous reproduction is a reproduction of which songs are simultaneously reproduced. It is determined whether or not such a point has occurred. When a point at which a song is prepared has not occurred, the flow of the processes returns to step S14. At step S14, it is determined whether or not such point has occurred. When a point at which the next song is prepared has occurred (YES), the flow of the processes returns to step S2.

FIG. 5 is a schematic diagram showing time-based meta data 30. As described above, the meta data 30 are time-based auxiliary data added to a song. The meta data 30 describes not only information about a tempo, but position information of beats, bar beginning position information, and melody information of an introduction, a catchy part, and so forth. A bar/beat 31 represents a beat count in the first bar. "11" represents the first beat in the first bar. "14" represents the fourth beat in the first bar. Likewise, "21" represents the first beat in the second bar. In particular, "11" and "21" represent the first beat of each bar. An attribute 32 represents an entity at the position. The attribute 32 represents the position of the beginning of a bar, a normal beat, a melody, a theme (a catchy part), or the like. "01800001" represents the beginning of a bar as an attribute of "11" and "21". When a song has been sampled at 44.1 kHz, the number of samples per second is 44100. The position is described in the unit of a sample. The meta data 30 shown in FIG. 5 are described in the text format or binary format.

Figure 6:
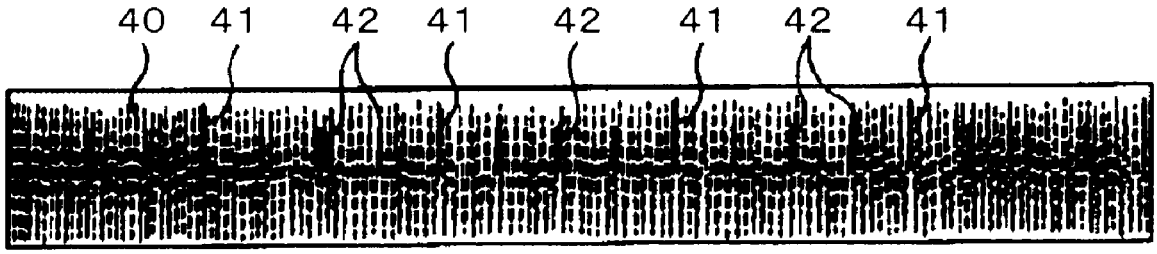
FIG. 6 is a schematic diagram showing a specific example of time-based meta data.

FIG. 6 shows a specific example of time-based meta data. FIG. 6 shows time-based meta data of an audio signal 40 and beats 41 and 42 at a time. The audio signal 40 change left to right as time elapses and the beats ride on the audio signal 40. In FIG. 6, a long line 41 represents a first beat of a bar whereas a short line 42 represents a regular beat. The positions of the first beat 41 of a bar and other beats 42 (three beats at a timing of a quarter note after the beginning of a bar in a four-beat rhythm) are stored corresponding to sample positions of the song.

Figure 7:
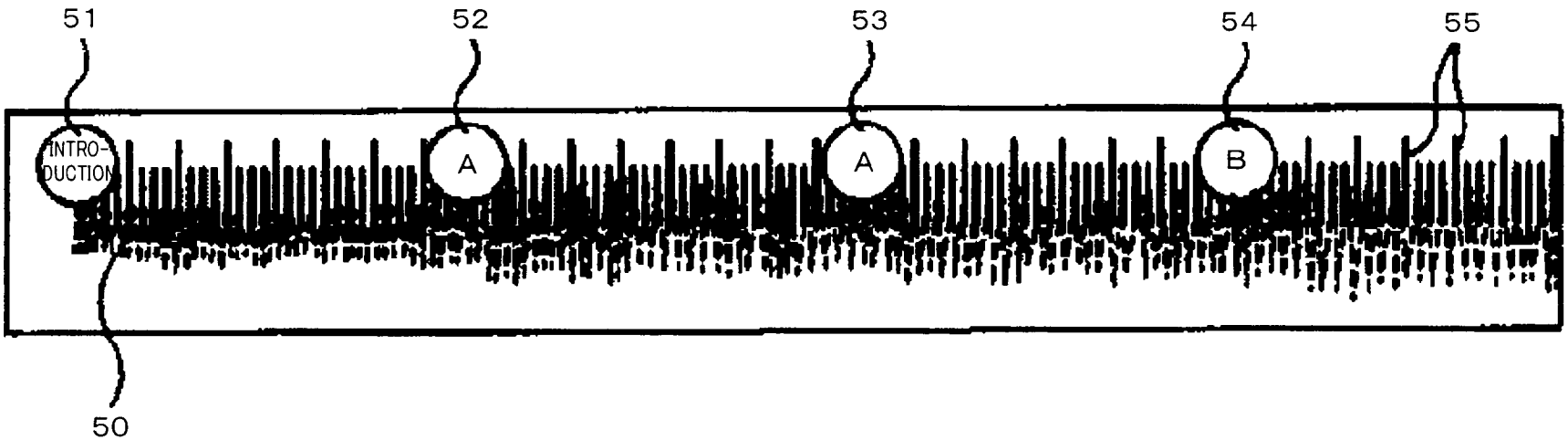
FIG. 7 is a schematic diagram showing another specific example of time-based meta data.

FIG. 7 is a schematic diagram showing another specific example of time-based meta data. An audio signal 50 can contain not only beat positions 55, but position information that represents a melody composition such as an introduction 51, A melodies 52 and 53, a B melody 54, and a theme (a catchy part) of a song. With this information, the positions of bars and the start position of a particular melody of an objective song can be obtained.

Figure 8A:
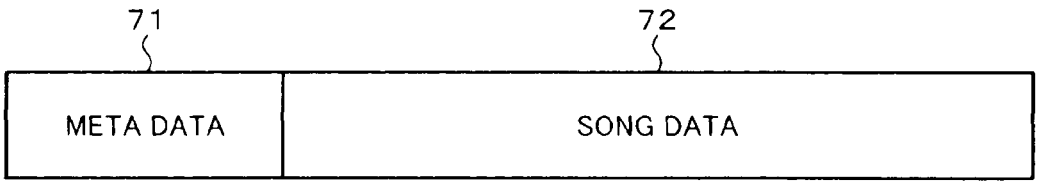
FIG. 8A, FIG. 8B, and FIG. 8C are schematic diagrams showing a method of storing meta data.
Figure 8B:
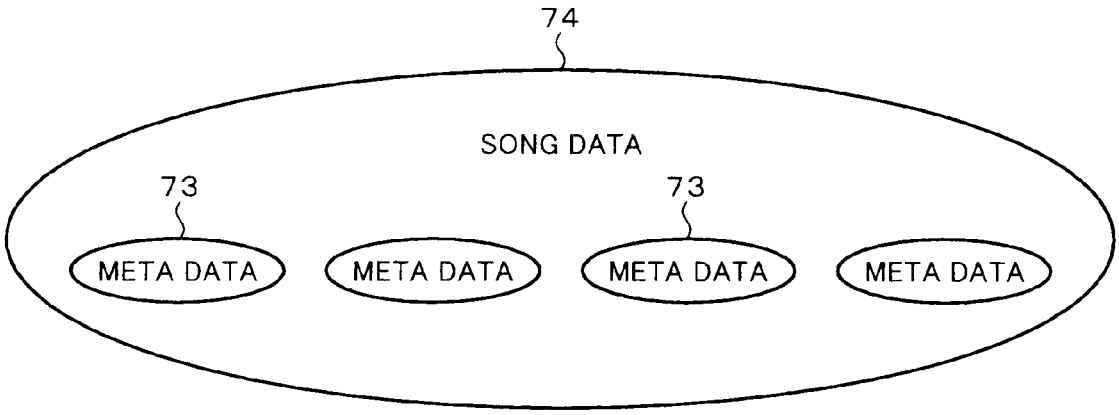
Figure 8C:
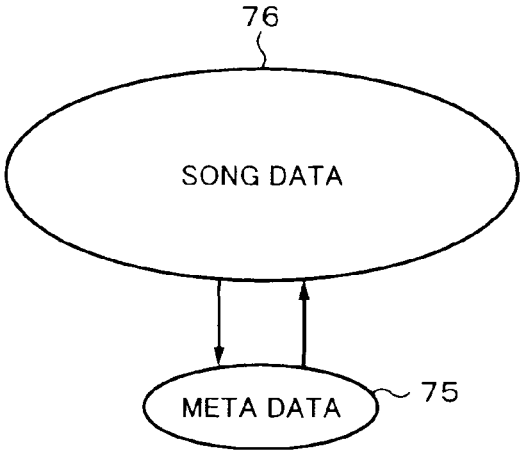

In the music editing apparatus 1 having the structure shown in FIG. 1 and so forth, meta data were stored in the meta data storage unit 6. Instead, meta data may be stored as shown in FIG. 8A, FIG. 8B, and FIG. 8C. FIG. 8A shows an example of which meta data 71 and song data 72 are logically separated and present physically in the same medium as in MP3. FIG. 8B shows an example of which meta data 73 coexist with song data 74 as in MPEG4. FIG. 8C shows an example of which meta data 75 corresponding to song data 76 are retrieved, for example, through a network. In this case, song data and meta data are logically and physically separated from each other. This structure applies to music editing apparatus 80 and 110 (that will be described later) having a network communicating unit connected to a network such as the Internet. This structure allows meta data to be downloaded from a site on the network according to a song ID.

FIG. 9 is a schematic diagram showing a specific example of a remix pattern file. Although meta data correspond to one song in one-to-one relationship, the user can freely create a remix pattern. Thus the user can create a remix pattern regardless of songs. A remix pattern file is a file that describes in what manner to connect songs. In a remix pattern 60, ID_A to ID_E of a song ID (file) 61 may be the same as song names A to E, respectively. Instead, ID_A to ID_E may be absolute file names or file paths. A reproduction portion 62 represents what part of each song to reproduce. In this example, a portion of "a catchy part" is designated for song A, a portion of "an introduction" is designed for song B, a portion of "8th bar to 20th bar" is designated for song C, a portion of all is designated for song D, and a portion of "a catchy part" is designated for song E. An (effect) upon reproduction 63 designates what effect to apply to each part of each song. A connecting method (pattern) 64 denotes that song A is cross-fade, song B is connected with cross-fade, song B and song C are connected with cut-in, song C and song D are connected with cross-fade, and song D and song E are connected such that their catchy parts simultaneously reproduced. An (effect) upon connection 65 designates that songs are connected with reverb, low-cut, or distortion as an effect. A connection SE 66 designates a sound effect.

When the pattern shown in FIG. 9 is designated, real reproduction is performed as follows. "The catchy part of ID_A is reproduced. → At the near end of the catchy part of ID_A, the introduction of ID_B is cross-faded. → At the end of the introduction of ID_B, the reproduction of the eighth bar of ID_C is started. → ID_D is cross-faded several bars after 20 bars of ID_C. At the same time, SE_A is also mixed. → When the catchy part of ID_D is reproduced, the catchy part of ID_E is also reproduced."

Thus it can be said that a remix pattern is a conceptual entity of a designation of what parts of songs are connected in what manner is added to a conventional play list.

Figure 23:
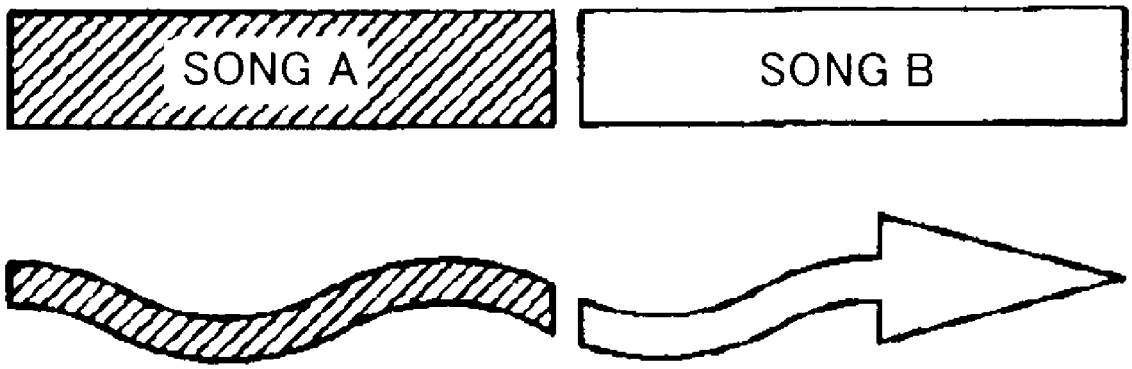
FIG. 23 is a schematic diagram for describing conventional music reproduction.

Next, with reference to FIG. 10 to FIG. 17, a specific example of a method of connecting songs will be described in brief. In the conventional music reproduction, as shown in FIG. 23, two songs A and B are reproduced with their original tempos and it is most likely that there is a non-sound region between two song A and song B. Although songs may be mechanically connected without a non-sound region using a particular reproducing apparatus, many songs have a non-sound region at the beginning and the end. Since these songs partly contain a non-sound region, it is inevitable that there is a non-sound region between these songs.

Figure 10:
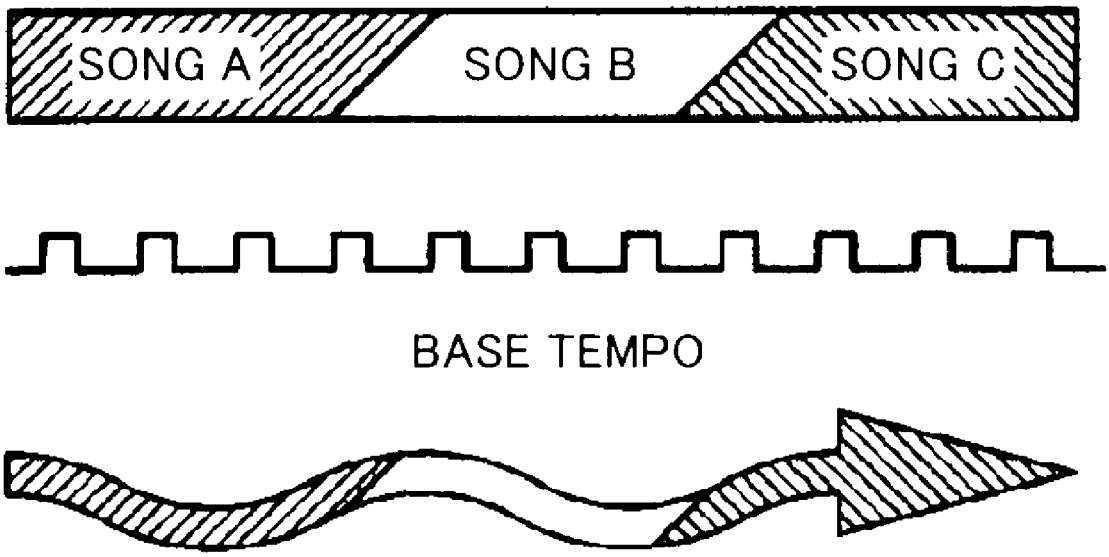
FIG. 10 is a schematic diagram for describing music reproduction according to the present invention.

In the music editing apparatus 1 shown in FIG. 1, as shown in FIG. 10, since the tempos of all songs A, B, and C are matched with the common tempo decided by the user or the system and the songs A, B, and C are reproduced with the matched tempo rather than their original tempos at the matched beat positions (down beat positions) of these songs, they can be seamlessly connected without causing the user to feel discomfort.

To do that, as described above, the music editing apparatus 1 reproduces song A, song B, and song C in such a manner that their beats are synchronized. To reproduce the three songs having different tempos in such a manner that their beats are synchronized, it is necessary to know their original tempos and their beat positions of songs A, B, and C. In addition, to match the tempos and beat positions of the songs to be reproduced, it is necessary to change the reproduction speeds of the songs.

To know the original tempos and beat positions of the songs A, B, and C, the music editing apparatus 1 uses time-based meta data paired with the songs. When the songs are reproduced, their reproduction speeds are changed on the basis of the ratios of their original tempos and the tempo of the current master beat and the beginning positions of the bars of the songs are matched.

As described above, by accurately handling the tempos and beat positions of the plurality of songs and controlling their reproduction positions in real time, their synchronous reproduction is performed. It is assumed that the technique of seamlessly connecting songs is based on the use of the method of beat synchronous reproduction.

Figure 11:
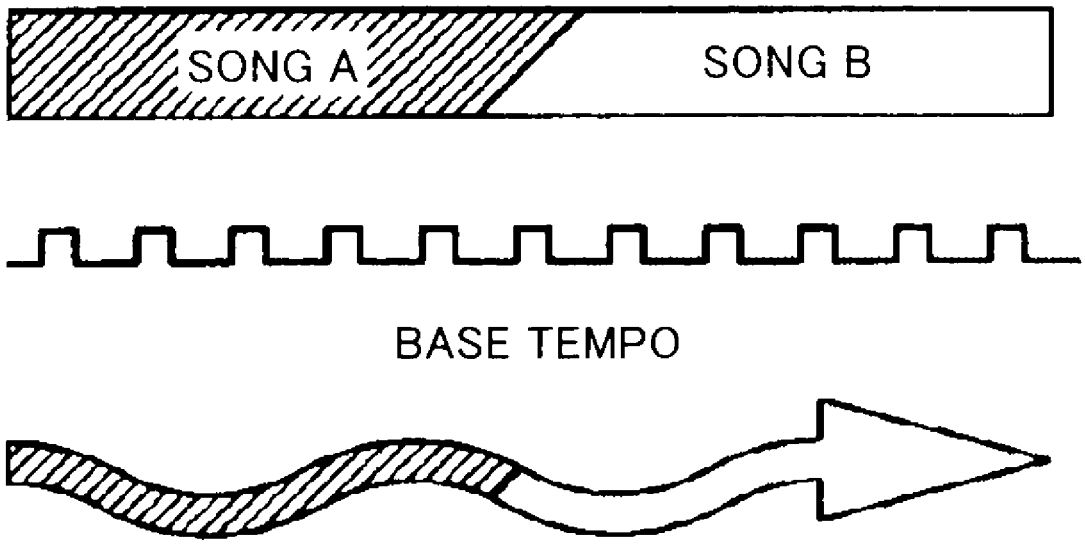
FIG. 11 is a schematic diagram for describing a connection with cross-fade.

FIG. 11 shows an example of which song A and song B are overlaid with their beats matched and they are connected by the cross-fade process. By fading out the current song A (gradually decreasing the sound volume) with the next song B faded in (gradually increasing the sound volume) and simultaneously reproducing both the songs, an effect of which they are seamlessly switched is obtained. Cross-fade is a technique that has been widely used, for example, in FM radio broadcasts. The point of the present invention is in that since the tempos and beat positions of song A and song B are matched, they are seamlessly connected without causing the user to feel discomfort.

Figure 12:
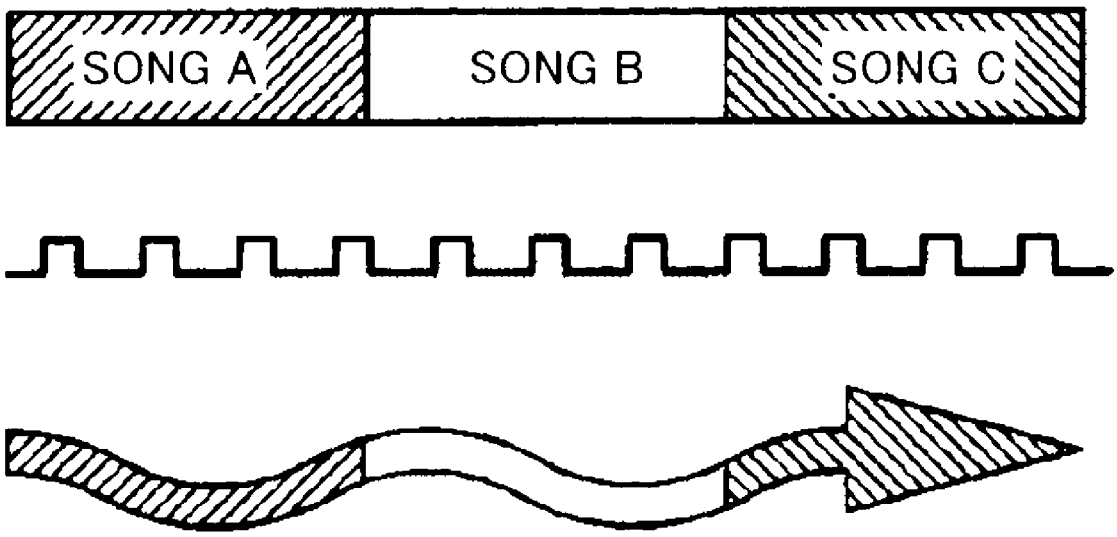

The music editing apparatus 1 can perform a cut-in process that is outlined in FIG. 12. When connections of song A, song B, and song C are musically clear, it may be preferred that they be directly connected as shown in FIG. 12 rather than they are connected with cross-fade. In addition, a song may be intentionally stopped at the end of a beat and the next song may be started at the beginning of the next beat.

Figure 13:
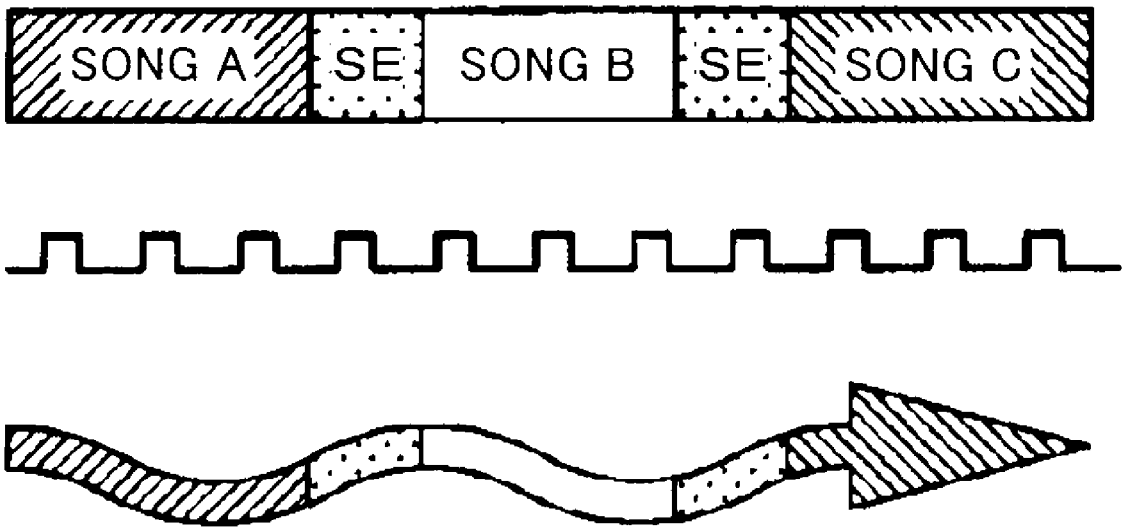
FIG. 13 is a schematic diagram for describing a connection using a sound effect.
Figure 14:
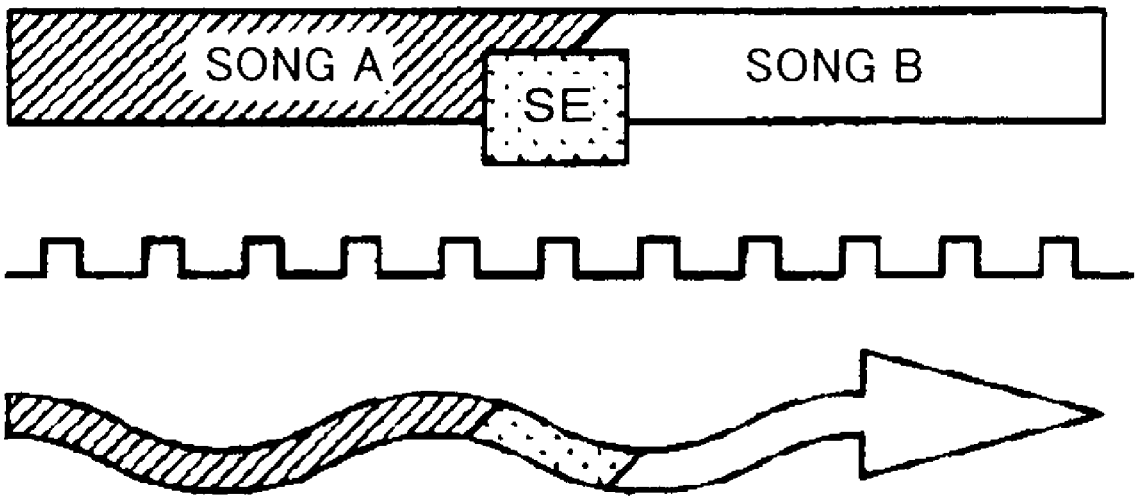
FIG. 14 is a schematic diagram for describing connections with cross-fade using a sound effect.

The music editing apparatus 1 connects songs with a sound effect (SE) as described above. In other words, a sound effect (SE) can be interposed not only between songs, but at a connecting portion of songs and at any portion of a song. FIG. 13 is an example of which sound effects are interposed between song A and song B and between song B and song C. FIG. 14 is an example of which a sound effect is interposed between song A and song B that are cross-faded. Of course, in this case, the sound effects can be synchronized with the tempo of the master beat. When SE is interposed or overlaid between songs, songs having much different melodies can be can be more naturally connected.

Figure 15:
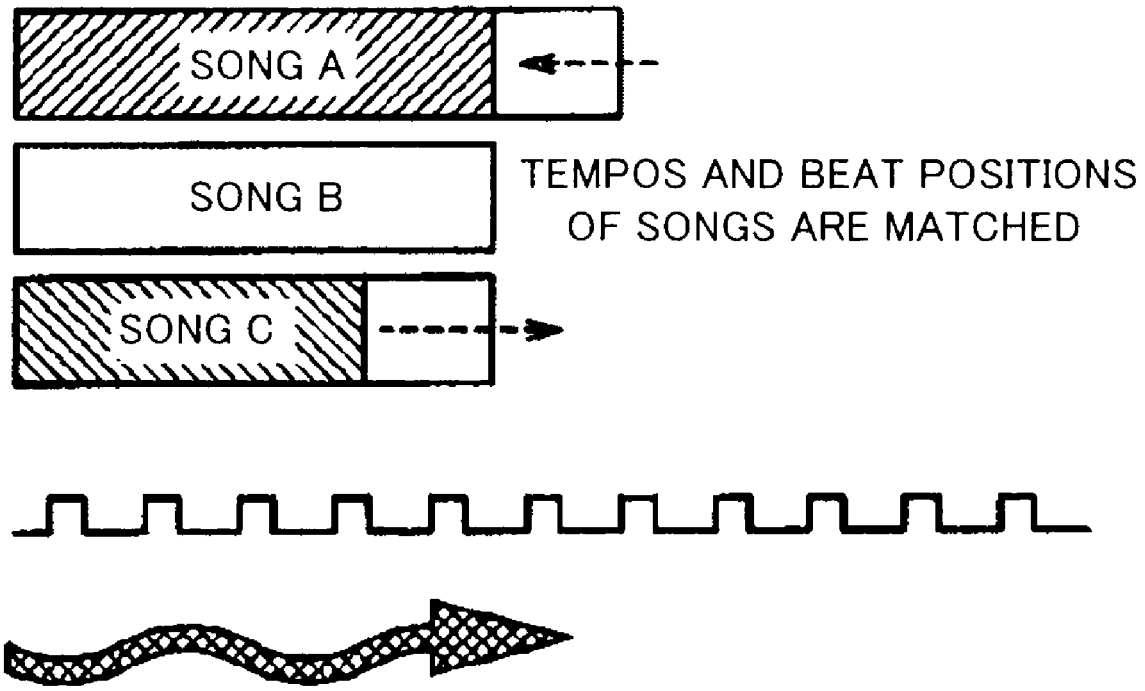
FIG. 15 is a schematic diagram for describing simultaneously synchronous reproduction.

In addition, the music editing apparatus 1 can perform the simultaneous reproduction. In this case, different songs are not only simultaneously reproduced, but their beats are synchronized and the songs are reproduced as shown in FIG. 15. Since the tempos and beat positions of the songs are synchronized, the user may feel as if he or she listened to one song.

Figure 16:
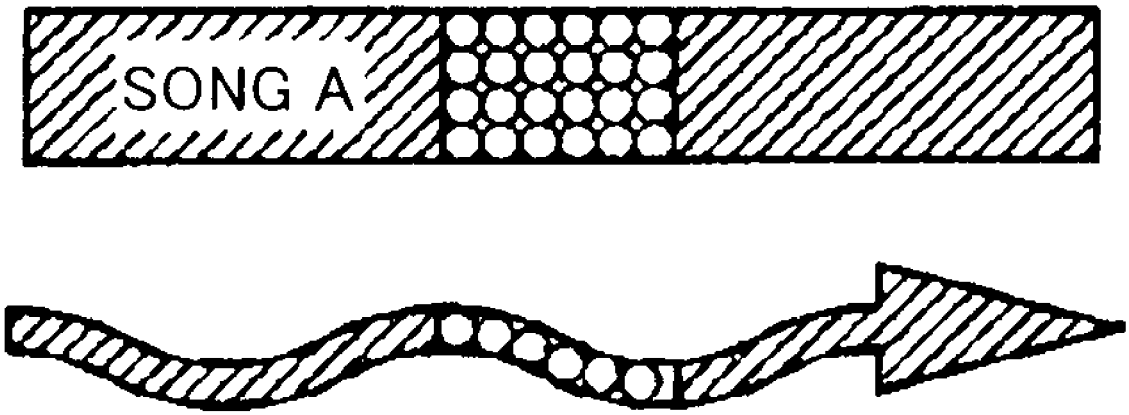
FIG. 16 is a schematic diagram for describing an application of an effect.

In addition, as shown in FIG. 16, the music editing apparatus 1 may apply an effect in one song A. In this case, the music editing apparatus 1 applies an effect (sound effect) to a part or all of sound A to change the sound quality. This sound effect includes not only a process of emphasizing the bass and treble of a song, but a process of changing the tone such as reverb, delay, distortion, or maximizer.

While applying reverb as an effect to music A and low-cut filter as an effect to music B, when these songs are simultaneously reproduced or connected in various manners, more natural and attractive connecting methods can be accomplished.

Figure 17:
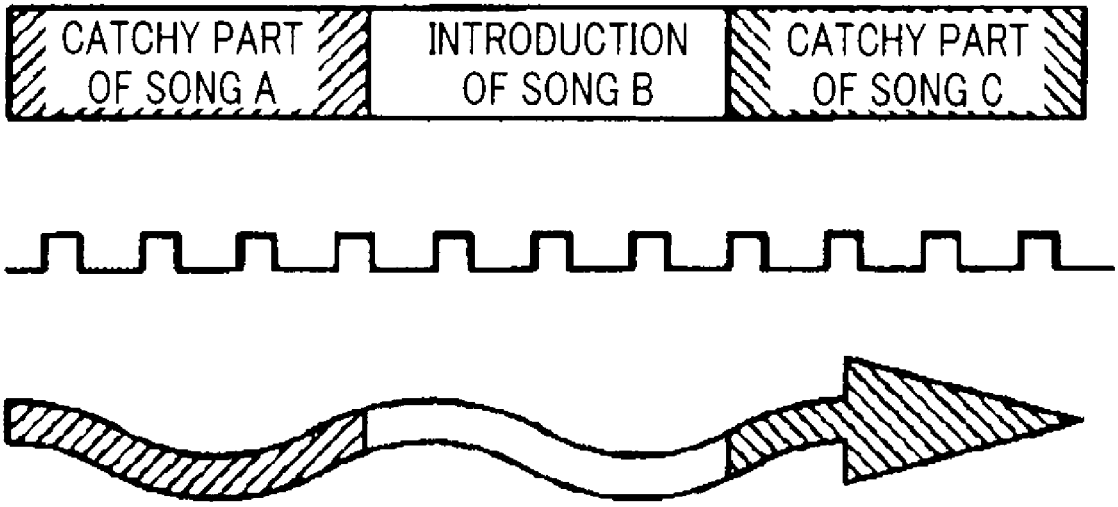
FIG. 17 is a schematic diagram for describing partial reproduction.

In addition, the music editing apparatus 1 may apply the foregoing connecting methods not only to a whole song, but to a catchy part or an introduction of each song as shown in FIG. 17. When parts of songs are connected, for example, only catchy parts may be remixed.

As described above, the music editing apparatus 1 can seamlessly remix songs based on a remix pattern file that describes a remix pattern. In this case, the music editing apparatus 1 may decide the tempo of the master beat that the user has designated or match the tempos of songs with the tempo of a main song.

Thus, with the music editing apparatus 1, the user can enjoy music not only in the conventional manner, but in the following new type manner. Unlike the conventional manner, this new type manner cannot be achieved only by passively listening to music. This new type manner allows the user to actively concern himself or herself in music, create a music listening method corresponding to his or her lifestyle, and satisfy his or her exhibitionism.

In other words, the user can stylishly connect his or her favorite parts of songs and listen to them as seamless remix music. In addition, with the music editing apparatus 1, the user can satisfy his or her creative desire for selecting a connecting method of songs on try-and-error basis and creating an attractive remix.

Figure 18:
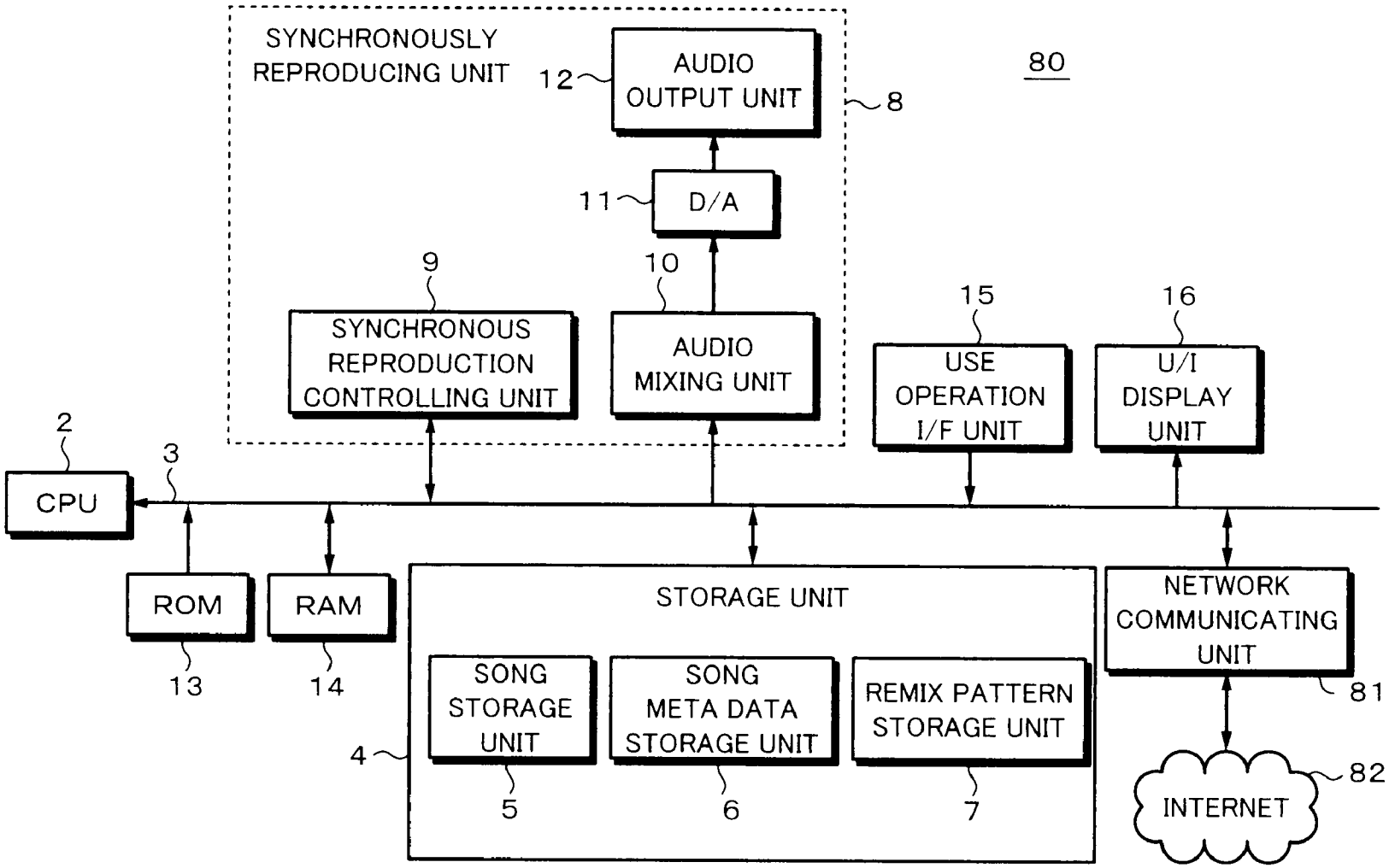
FIG. 18 is a schematic diagram showing a structure of a music editing apparatus having a network communicating unit.
Figure 19:
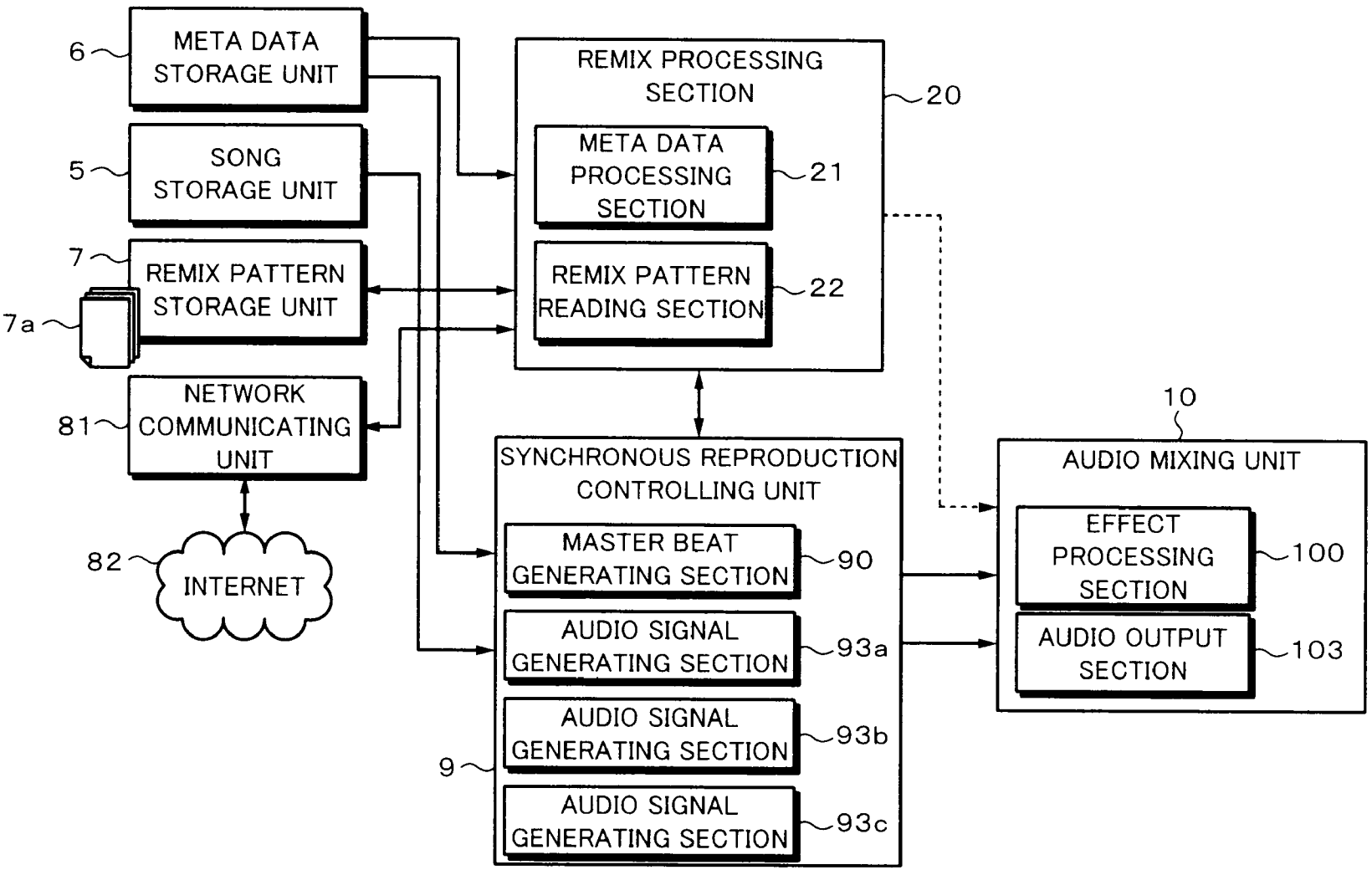
FIG. 19 is a functional block diagram of the music editing apparatus having the network communicating unit.

FIG. 18 shows a structure of another music editing apparatus 80 according to an embodiment of the present invention. FIG. 19 is a functional block diagram of the music editing apparatus 80. The music editing apparatus 80 has a network communicating unit 81 that can be connected to the Internet 82.

With the network communicating unit 81, the meta data can be downloaded from a site on the network. When the user knows only the ID of his or her desired song, as shown in FIG. 8, the meta data can be downloaded through the Internet.

The user can exchange and/or share a remix pattern file through a network such as the Internet 82 and a third party can download a remix created by another user and enjoys it. Instead, a remix pattern provided by a content service side rather than a private user may be used.

With the music editing apparatus 80, a new music-based communication through which connecting methods for songs are published on the Internet or the like, they are shared by other persons, and remixes are created and evaluated by a plurality of persons can be accomplished. In addition, when the user knows only the ID of his or her desired song, the meta data of the song can be downloaded from a server on the Internet.

Figure 20:
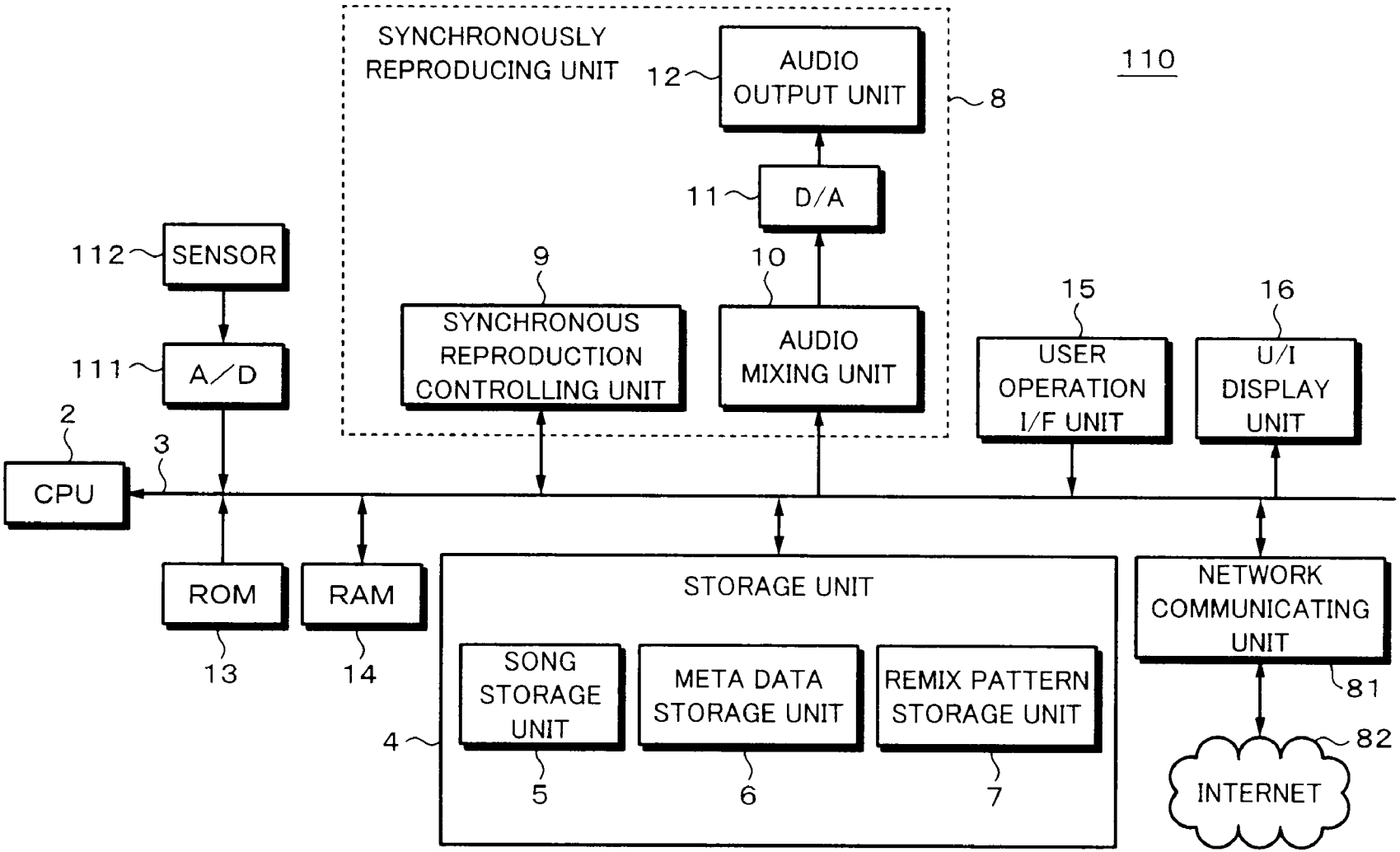
FIG. 20 is a schematic diagram showing a structure of the music editing apparatus having a sensor value obtaining section.
Figure 21:
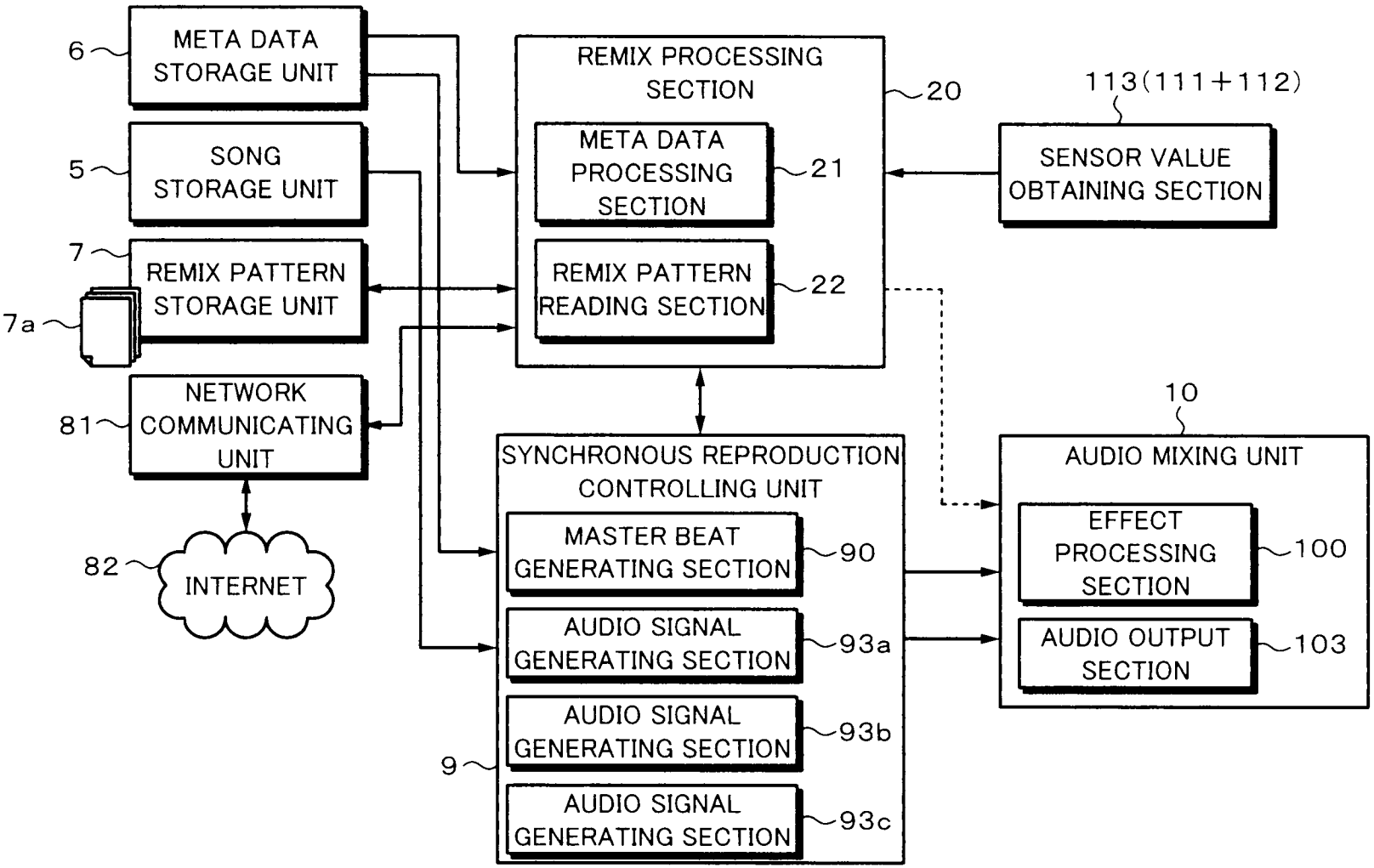
FIG. 21 is a functional block diagram showing the music editing apparatus having the sensor value obtaining section.

FIG. 20 and FIG. 21 show a hardware structure and a functional block diagram of another music editing apparatus 110, respectively. The music editing apparatus 110 has a structure of which a sensor value is obtained from a sensor 112 through an A/D converter 111. The music editing apparatus 110 functionally has a sensor value obtaining section.

As in an invention disclosed, for example, as "Reproduction State Controlling Apparatus And Reproduction Sate Controlling Method" (Japanese Patent Application Laid-Open No. 2003-391359), a sensor value obtaining section 113 is based on a technique of detecting a walking tempo using an acceleration sensor and changing the tempo of a song corresponding to the walking tempo. When this example is applied, the tempo of the master beat generating section can be changed corresponding to the walking tempo and all songs can be reproduced as remixes corresponding to the walking tempo and jogging tempo. In addition, as in "Method Of Changing Songs" ("Reproducing Apparatus And Reproducing Method For Audio Signal" (Japanese Patent Application No. 2005-303099)), an invention of selecting songs corresponding to the walking tempo or jogging tempo may be applied.

To apply these techniques, a sensor is essential. When the sensor and the algorithms of these inventions are applied to the system of the present invention, songs can be selected corresponding to the state of the user, the selected songs can be remixed, and they can be seamlessly reproduced.

Figure 22A:
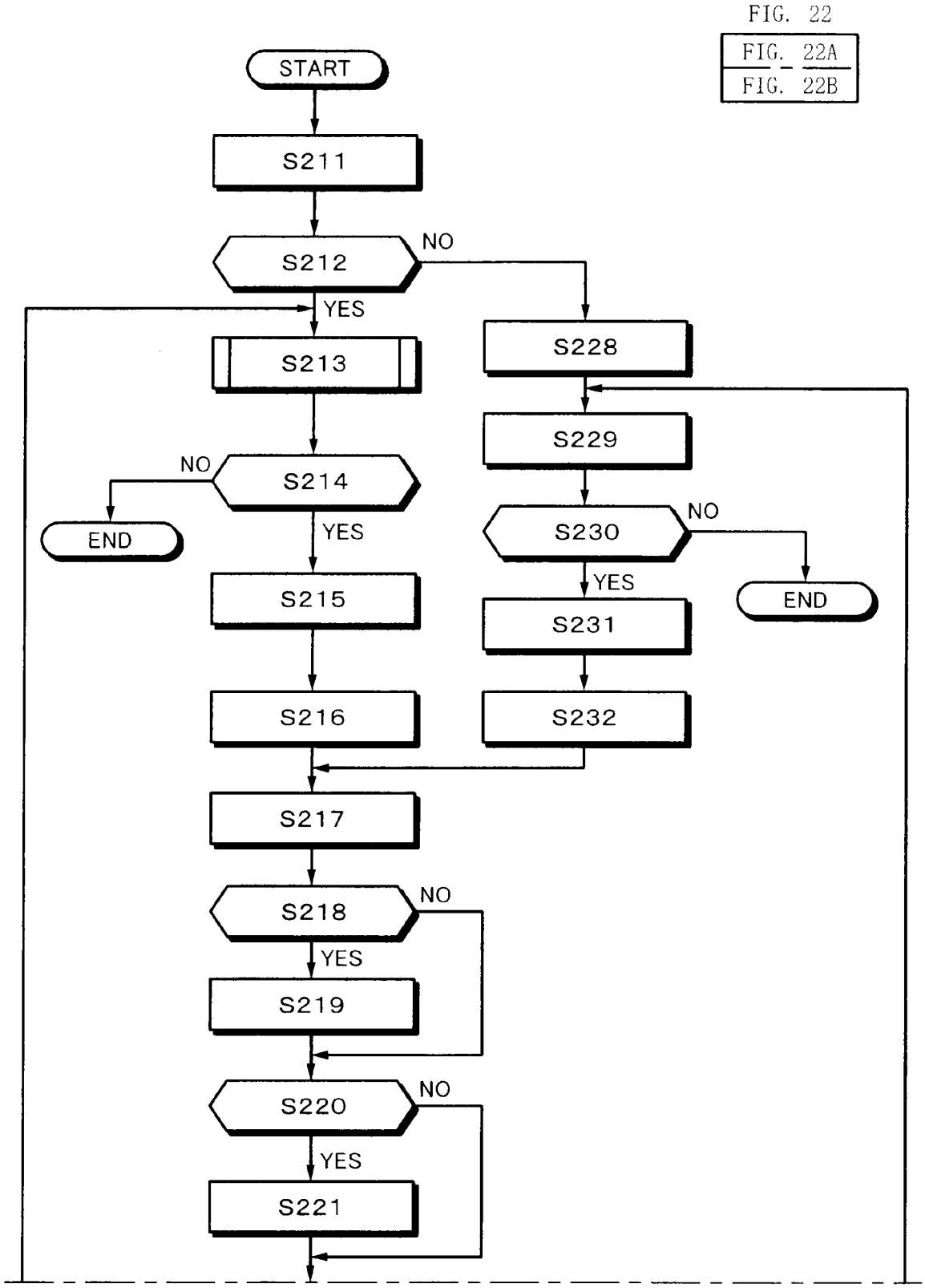
FIG. 22A and FIG. 22B are flow charts showing processes of the music editing apparatus having the sensor value obtaining section.
Figure 22B:
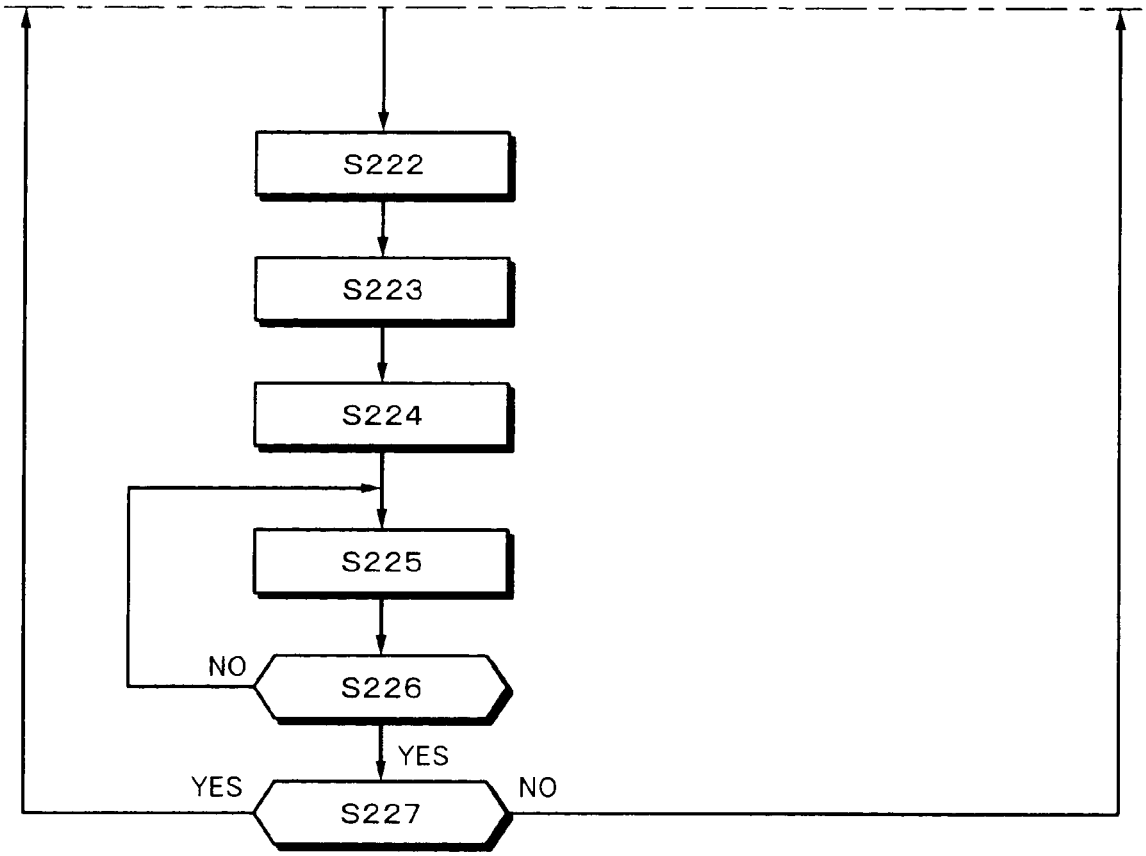

FIG. 22A and FIG. 22B are flow charts showing processes of the music editing apparatus 110 having a sensor priority mode. The processes have a sensor priority mode in addition to a remix pattern priority mode. Processes change, for example, depending on the mode that the user selects. In the sensor priority mode, the sensor detects, for example, a walking pattern or a jogging pattern and the music editing apparatus 110 changes beats corresponding to the detected pattern.

First, it is determined whether the mode of the music editing apparatus 110 is the sensor priority mode or the pattern priority mode (at step S211). In this case, the sensor priority mode is based on the technique of selecting songs depending on whether the user is walking or jogging. The sensor decides the order of songs and selects songs. Thus songs may not be decided corresponding to a pattern. It may suggest that they are dynamically changed. In other words, as a concept, the music editing apparatus 110 dynamically creates a pattern file with a value supplied from the sensor, not read a prefixed pattern file.

When the pattern priority mode rather than the sensor priority mode has been selected at step S211, the same processes shown in FIG. 4 are performed.

Next, the case of which the sensor priority mode has been selected at step S211 or step S212 will be described. In this case, songs are automatically selected corresponding to jogging and the selected songs are automatically connected corresponding thereto.

As a subroutine, songs and their tempos are decided corresponding to the input from the sensor (at step S213). When the determined result at step S214 denotes that there is another song, the flow advances to step S215. At step S215, the tempo of a master beat is set. In this case, the tempo of the master beat has been detected and set corresponding to the walking tempo. In this case, since the song connecting method has not been always decided, it is automatically decided (at step S216). For example, in the jogging mode, all the songs may be simply connected with cross-fade. Instead, when meta data of the next song denotes that it is fad in, the current song may be simply overlaid. Since the processes after step S217 are the same as those from step S6 to step S15 of FIG. 4, their description will be omitted.

Thus, with the music editing apparatus 110, songs are selected corresponding to the jogging tempo and the selected songs are seamlessly connected. Thus, since the songs do not disorder the tension and tempo of jogging, the user can comfortably enjoy jogging. With a particular type of a sensor, a remix corresponding to another rhythmical motion (for example, dancing) or the heart rate of the user instead of jogging can be created.

Songs are selected corresponding to the input from the sensor, the tempos of the selected songs are matched with the tempo of the jogging, and the songs are remixed with the matched tempo. Thus the user can enjoy his or her favorite songs corresponding to his or her tempo.

In addition, timer remix reproduction can be performed. It is assumed that the user wants to listen to songs of his or her favorite album or those of a play list in 30 minutes for his or her commuting. Conventionally, if the duration of the album is 60 minutes, he or she has to stop reproducing songs in 30 minutes. In contrast, with the system according to the present invention, a remix can be created by selecting tempos and parts of songs so that the reproduction duration of songs becomes 30 minutes. The timer remix reproduction can be applied to jogging. When the user wants to jog only for 30 minutes, a remix of songs for 30 minutes corresponding to the tempo of jogging can be created.

A remix of only catchy parts of songs for 30 minutes of commuting can be created so that the remix is complete when the user arrives at the destination. In addition, as the current time approaches the arrival time, an atmosphere that allows the user to feel that he or she is approaching the destination can be created in such a manner that the tempo of songs is gradually decreased or particular SE is overlaid.

As described above, with the music editing apparatus 80 and 110, a new music-based communication through which a connecting method for songs is published, for example, on the Internet, shared by other persons, remixes are created by a plurality of persons, and they are evaluated by them can be achieved. In addition, meta data corresponding to a song can be downloaded from a site on the Internet. Moreover, with a sensor, the user can listen to music that well fits his or her situation and state.

These features will make a new wave against the conventional world in which the user enjoys work that professional creators and musicians created and allow the user to experience a new world in which he or she reuses and recomposes their work as materials with which he or she expresses himself or herself and enjoy the result.

When users who find an amusement in such a new type music increase, the entire music industry will become active. In addition, from a view point of the music industry side, there is a possibility of which there will be music work that allows the user side to recompose and new creators to create such work. Thus there is a possibility of which the industry and users can establish new music cultures.

Last, the features that can be used in the music editing apparatus according to the present invention will be described. This music editing apparatus is a song creating and reproducing apparatus having a reproducing section composed of a plurality of reproduction controlling units that match tempos and downbeats of a plurality of songs stored in the storage unit at a predetermined timing and synchronously reproduce the plurality of songs at the same time. In addition, the songs are characterized in that whole or part of each of the songs is used. In addition, the songs are characterized in that they are not limited to musically composed songs, but include sounds such as sound effects, conversation, and announcement.

In addition, the music editing apparatus is characterized in that when the synchronizing reproduction is performed, a sound generation can be started/stopped at any song start position and at any timing of any song. In addition, the music start position and timing can be designated particularly in the unit of one bar, one beat, and one melody composition unit.

In addition, with the foregoing characteristics, while a particular song is being reproduced, any part of another song can be simultaneously reproduced at any timing. Likewise, with the foregoing characteristics, the reproduction of any part of a song that is being reproduced can stopped and any part of another song can be seamlessly reproduced.

In addition, the music editing apparatus is characterized in that while it is performing the foregoing synchronizing reproduction, it can discretely adjust the sound volume of each of songs that it simultaneously reproduces. With the sound volume adjustment, while the apparatus is performing the simultaneous reproduction, it can decrease the sound volume of a song that it is currently reproducing, increase the sound volume of the next song, combine the resultant songs, and reproduce them.

In addition, the apparatus is characterized in that while it is performing the synchronizing reproduction, it can apply an effect process as a signal process to each of songs for the synchronizing reproduction. In addition, the apparatus is characterized in that while it is performing the synchronizing reproduction, it controls timings based on meta data composed of tempo, bar, down-beat position, melody composition change position information, and so forth that have been recorded to each song.

The music editing apparatus is characterized in that meta data and a song are recorded in the same file or different files and the relationship therebetween is managed with a database and an identifier and that the range of songs, sound generation start timing, sound volume control method, and type of effect process for the synchronizing reproduction are controlled in real time based on a pattern file that describes a song creating and reproducing method.

In addition, the music editing apparatus is characterized in that the tempo is designated by the user or is automatically decided by the apparatus and that as a tempo that is automatically decided by the apparatus, input data from a sensor are used.

The sensor is characterized in that it can be added to the apparatus and includes any types such as an acceleration sensor, a gyro sensor, a heart rate sensor, a body temperature sensor, a body motion sensor, and a cerebral wave sensor. The pattern file is characterized in that it is not only recorded in the storage unit of the apparatus, but it may be obtained from an external storage unit or through the Internet.

According to the present invention, editing of overlaying or connecting whole or part of each of many songs recorded in a record medium such as a hard disk or a flash memory with their beats matched can be accomplished. In addition, whole or part of each song can be connected situation by situation in real time and the connected song can be reproduced.

| DESCRIPTION OF REFERENCE NUMERALS | |
|---|---|
| 1 | MUSIC EDITING APPARATUS |
| 2 | CPU |
| 4 | STORAGE UNIT |
| 5 | SONG STORAGE UNIT |
| 6 | META DATA STORAGE UNIT |
| 7 | REMIX PATTERN STORAGE UNIT |
| 8 | SYNCHRONOUSLY REPRODUCING UNIT |
| 9 | SYNCHRONOUS REPRODUCTION CONTROLLING UNIT |
| 10 | AUDIO MIXING UNIT |
| 20 | REMIX PROCESSING SECTION |
| 21 | META DATA PROCESSING SECTION |
| 22 | REMIX PATTERN READING SECTION |
| 90 | MASTER BEAT GENERATING SECTION |
| 93a, 93b, 93c | AUDIO SIGNAL GENERATING SECTION |
| S1 | OBTAIN REMIX PATTERN FILE. |
| S2 | OBTAIN NEXT SONG. |
| S3 | IS THERE NEXT SONG ? |
| S4 | DECIDE TEMPO OF MASTER BEAT. |
| S5 | OBTAIN CONNECTION PATTERN. |
| S6 | OBTAIN META DATA OF SONG. |
| S7 | IS EFFECT PROCESS NECESSARY ? |
| S8 | ACTIVATE EFFECT PROCESSING SECTION. |
| S9 | IS SOUND VOLUME FADE PROCESS NECESSARY ? |
| S10 | SET FADE PARAMETER. |
| S11 | SET ORIGINAL TEMPO OF SONG TO SYNCHRONOUS REPRODUCTION CONTROLLING SECTION. |
| S12 | OBTAIN FREE AUDIO SIGNAL GENERATING SECTION. |
| S13 | SET SONG TO SYNCHRONOUS REPRODUCTION CONTROLLING SECTION. |
| S14 | OBTAIN CURRENT REPRODUCTION POSITION OF EACH SONG. |
| S15 | HAS POINT AT WHICH NEXT SONG IS PREPARED OCCURRED ? |
| S211 | DECIDE SENSOR PRIORITY MODE OR PATTERN PRIORITY MODE. |
| S212 | SENSOR PRIORITY MODE ? |
| S213 | DECIDE SONG AND TEMPO CORRESPONDING TO INPUT FROM SENSOR. |
| S214 | IS THERE NEXT SONG ? |
| S215 | SET TEMPO OF MASTER BEAT. |
| S216 | AUTOMATICALLY DECIDE CONNECTION PATTERN. |
| S217 | OBTAIN META DATA OF SONG. |
| S218 | IS EFFECT PROCESS NECESSARY ? |
| S219 | ACTIVATE EFFECT PROCESSING SECTION. |
| S220 | IS SOUND VOLUME FADE PROCESS NECESSARY ? |
| S321 | SET FADE PARAMETER. |
| S222 | SET ORIGINAL TEMPO OF SONG TO SYNCHRONOUS REPRODUCTION CONTROLLING SECTION. |

-continued

| DESCRIPTION OF REFERENCE NUMERALS | |
|---|---|
| S223 | OBTAIN FREE AUDIO SIGNAL GENERATING SECTION. |
| S224 | SET SONG TO SIMULTANEOUS REPRODUCTION CONTROLLING SECTION. |
| S225 | OBTAIN CURRENT REPRODUCTION POSITION OF EACH SONG. |
| S226 | HAS POINT AT WHICH NEXT SONG IS PREPARED OCCURRED ? |
| S227 | SENSOR PRIORITY MODE ? |
| S228 | OBTAIN REMIX PATTERN FILE. |
| S229 | OBTAIN NEXT SONG. |
| S230 | IS THERE NEXT SONG ? |
| S231 | DECIDE TEMPO OF MASTER BEAT. |
| S232 | OBTAIN CONNECTION PATTERN. |

The invention claimed is:

1. A music editing apparatus comprising:

a storage unit that stores a plurality of songs, including at least a first song and a second song;

a remix processing section which performs a remix process based on both meta data which are pre-generated corresponding to song data and which contain at least a time-based beat position and a file for deciding a remix pattern;

a synchronous reproduction controlling section which obtains the first song and second song, generates a master beat, sends the master beat to the remix processing section, adjusts the tempo of the first song and second song to be set to the master beat, and reproduces the first song and second song such that at least a portion of the first song and a portion of the second song are simultaneously reproduced based on individual entries of the meta data of the first song and second song and according to the remix process which the remix processing section has designated corresponding to the remix pattern and the meta data; and a mixing section which mixes songs reproduced by the synchronous reproduction controlling section.

2. The music editing apparatus as set forth in claim 1, wherein the remix processing section has a meta data processing section which processes the meta data and a remix pattern reading section which reads the remix pattern.

3. The music editing apparatus as set forth in claim 1, wherein the synchronous reproduction controlling section has a master beat generating section which generates the master beat and supplies the generated master beat to the remix processing section; and a plurality of audio signal generating sections which generate audio signals of a plurality of songs.

4. The music editing apparatus as set forth in claim 1, further comprising:

a meta data storage unit which stores the meta data;

and a remix pattern storage unit which stores the remix pattern.

5. The music editing apparatus as set forth in claim 1, wherein the synchronous reproduction controlling unit uses wholes or parts of the first song and second song.

6. The music editing apparatus as set forth in claim 3, wherein each of the plurality of audio signal generating sections of the synchronous reproduction controlling unit includes a decoder and a time stretch unit.

7. The music editing apparatus as set forth in claim 1, further comprising:

a network communicating unit which obtains the meta data from a server on a network.

8. The music editing apparatus as set forth in claim 1, further comprising:

a network communicating unit which allows the remix pattern file to be shared on a network.

9. The music editing apparatus as set forth in claim 1, further comprising:

a sensor value obtaining section which measures and obtains a user's walking or jogging tempo, and the synchronous reproduction controlling section generates a tempo of the master beat based on the measured tempo.

10. A music editing method, implemented on a music editing apparatus, comprising:

storing, at a storage unit, a plurality of songs including at least a first song and a second song;

a remix processing step of performing, at a remix processing section, a remix process based on both meta data which are pre-generated corresponding to song data and which contain at least a time-based beat position and a file for deciding a remix pattern;

a synchronous reproduction controlling step of obtaining, at a synchronous reproduction controlling section, the first song and second song, generating a master beat, sending the master beat to the remix processing section, adjusting the tempo of the first song and second song to be set to the master beat, and reproducing the first song and second song such that at least a portion of the first song and a portion of the second song are simultaneously reproduced based on individual entries of the meta data of the first song and second song according to the remix process which the remix processing section has designated corresponding to the remix pattern and the meta data; and a mixing step of mixing, at a mixing section, songs reproduced by the synchronous reproduction controlling section.

11. The music editing apparatus as set forth in claim 1, wherein the file for deciding a remix pattern includes information on how to transition from reproducing the first song to the second song.

12. The music editing apparatus as set forth in claim 11, wherein the information on how to transition from reproducing the first song to the second song indicates using one of a fade-out, a cut-out, and a sound effect.

* * * * *